US007392779B2

(12) United States Patent
Takahashi et al.

(10) Patent No.: US 7,392,779 B2
(45) Date of Patent: Jul. 1, 2008

(54) ENGINE EQUIPPED WITH AIR-INTAKE DEVICE FOR PERSONAL WATERCRAFT AND PERSONAL WATERCRAFT

(75) Inventors: Keiji Takahashi, Akashi (JP); Atsufumi Ozaki, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 0 days.

(21) Appl. No.: 11/728,039

(22) Filed: Mar. 23, 2007

(65) Prior Publication Data

US 2007/0221182 A1 Sep. 27, 2007

(30) Foreign Application Priority Data

Mar. 24, 2006 (JP) ..... 2006-082840

(51) Int. Cl.
*F02M 35/10* (2006.01)

(52) U.S. Cl. ..... 123/184.21; 123/184.47

(58) Field of Classification Search ..... 123/184.21, 123/184.47
See application file for complete search history.

(56) References Cited

FOREIGN PATENT DOCUMENTS

JP 11-022604 1/1999

*Primary Examiner*—Noah P. Kamen
(74) *Attorney, Agent, or Firm*—Alleman Hall McCoy Russell & Tuttle

(57) ABSTRACT

An engine equipped with an air-intake device for a personal watercraft, includes a cylinder head cover attached to an upper surface of a cylinder head, a plug cap with ignition coil configured to protrude upward from an upper surface of the cylinder head cover; and an air box for the air-intake device that is disposed above the cylinder head cover and is provided on a lower surface thereof with an air inlet that opens to be opposite to the upper surface of the cylinder head cover. The air box is disposed in such a manner that the lower surface of the air box is opposite to the upper surface of the cylinder head cover and a gap is formed between the lower surface of the air box and the upper surface of the cylinder head cover so as to form an air flow in the vicinity of the plug cap with ignition coil that is directed to the air inlet of the air box.

7 Claims, 6 Drawing Sheets

ENGINE EQUIPPED WITH AIR-INTAKE DEVICE FOR PERSONAL WATERCRAFT AND PERSONAL WATERCRAFT

TECHNICAL FIELD

The present invention relates to an engine equipped with an air-intake device for personal watercraft, and particularly to an engine including plug caps with ignition coils.

BACKGROUND OF THE INVENTION

In recent years, high-performance engines such as four-stroke engines and multi-cylinder engines for use with personal watercraft have been developed for the purpose of, for example, environmental friendliness. As such an engine, for example, an engine including plug caps with ignition coils is disclosed in Japanese Patent No. 3363747.

The plug caps with ignition coils have a structure in which each ignition coil for applying a high voltage to an ignition plug in response to an ignition command from a controller such as an ECU (electric control unit) is integral with the corresponding plug cap. In fields of automobiles and motorcycles, it has been demonstrated that the plug caps with ignition coils can achieve high power efficiency and correct ignition and can contribute to space saving.

When the plug caps with ignition coils are incorporated into the personal watercraft, the following problem arises.

For example, the personal watercraft has a construction in which the engine is disposed in an internal space of a body, namely, an engine room formed of a fiber-reinforced plastic (FRP), and thus has a substantially closed structure to inhibit water entry from the outside. The plug caps with ignition coils cannot radiate heat sufficiently by natural cooling, because the ignition coils are tightly contained in a limited space. In addition, temperature in the internal space of the body tends to increase because of its closed structure. This may further increase the temperature of the plug caps with ignition coils.

SUMMARY OF THE INVENTION

The present invention addresses the above described conditions and an object of the present invention is to provide an engine equipped with an air-intake device for a personal watercraft that is capable of suppressing temperature increase of plug caps with ignition coils.

According to the present invention, there is provided an engine equipped with an air-intake device for a personal watercraft, the engine comprising a cylinder head cover attached to an upper surface of a cylinder head; a plug cap with ignition coil configured to protrude upward from an upper surface of the cylinder head cover; and an air box for the air-intake device that is disposed above the cylinder head cover and is provided on a lower surface thereof with an air inlet that opens to be opposite to the upper surface of the cylinder head cover; wherein the air box is disposed in such a manner that the lower surface of the air box is opposite to the upper surface of the cylinder head cover and a gap is formed between the lower surface of the air box and the upper surface of the cylinder head cover so as to form an air flow in the vicinity of the plug cap with ignition coil that is directed to the air inlet of the air box.

In accordance with the engine constructed above, the plug cap with ignition coil is effectively cooled by the air being suctioned from the air inlet into the air box disposed above the cylinder head cover, through a region in the vicinity of the plug cap with ignition coil. As a result, temperature increase of the plug cap with ignition coil can be suppressed. In addition, since the air inlet of the air box is formed on the lower surface of the air box to open to be opposite to the upper surface of the cylinder head cover, leakage of sound generated by the air-intake of the engine to the outside is suppressed with the gap formed between the cylinder head cover or the cylinder head and the lower surface of the air box. Thus, the sound generated by the air-intake can be reduced.

The plug cap with ignition coil may include a plurality of plug caps with ignition coils, and the air inlet may be provided such that one air inlet corresponds to two plug caps with ignition coils of the plurality of plug caps with ignition coils. In such a construction, since the size of the air inlet is relatively small as compared to the size of the plug cap with ignition coil, the event that the air flow generated by the air-intake is suctioned into the air box through only a part of an opening of the air inlet will be suppressed. As a result, cooling efficiency of the two plug caps with ignition coils is high.

The air inlet may be provided such that one air inlet corresponds to one plug cap with ignition coil.

The air inlet may be disposed to include at least a part of a region immediately above the plug cap with ignition coil. In such a construction, since the air in the vicinity of the plug cap moves upward due to the temperature increase of the plug cap with ignition coil and is directly suctioned into the air box, cooling efficiency of the plug cap with ignition coil is improved.

The plug cap with ignition coil may include a plurality of plug caps with ignition coils. The air inlet of the air box may be formed by a hole elongated along a direction in which the plurality of plug caps with ignition coils are aligned. In such a construction, since the air inlet is elongated in shape to correspond to the plurality of plug caps with ignition coils that are typically aligned in the in-line engine, the plug caps with ignition coils can be efficiently cooled substantially uniformly. The air inlet may be provided such that one air inlet corresponds to two plug caps with ignition coils of the plurality of plug caps with ignition coils.

The above and further objects and features of the invention will more fully be apparent from the following detailed description with accompanying drawings.

DETAILED DESCRIPTION OF THE PREFERRED EMBODIMENTS

Hereinafter, embodiments of the present invention will be described with reference to the drawings.

Figure 1:
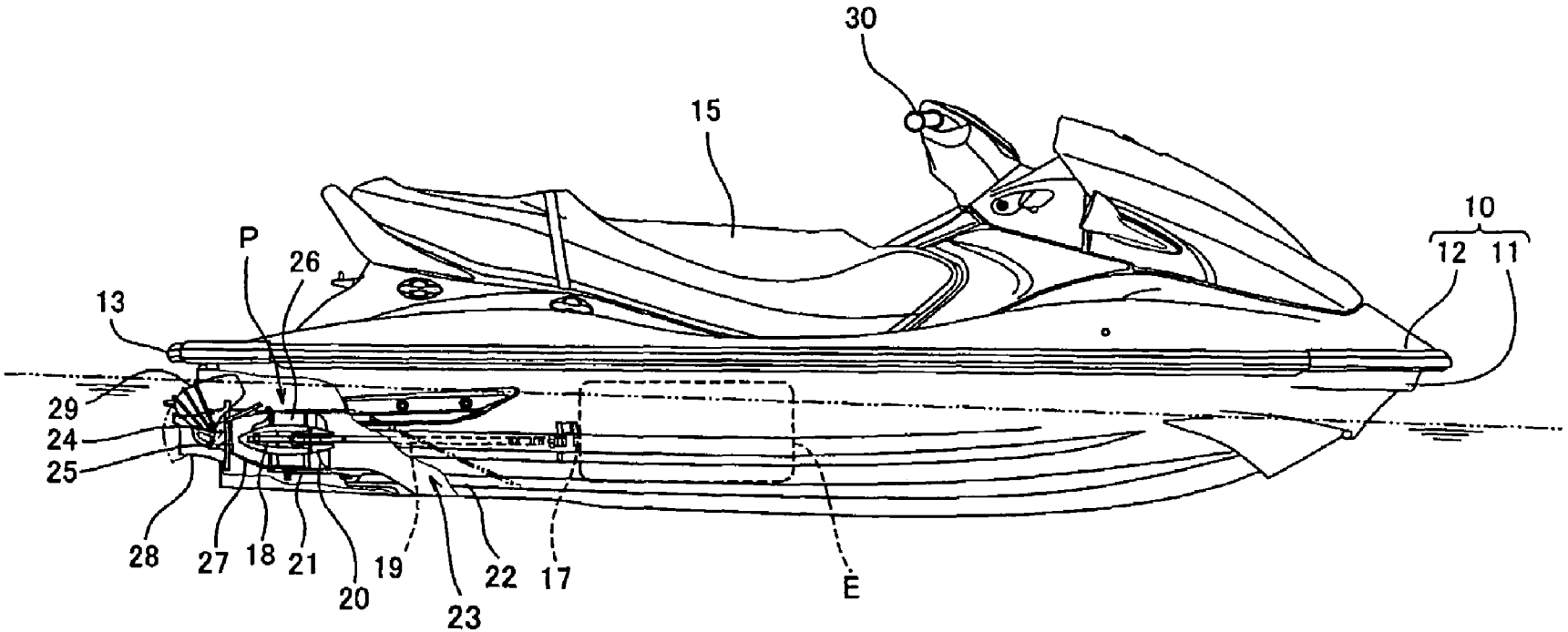
FIG. 1 is a right side view of a personal watercraft including an engine equipped with an air-intake device according to an embodiment of the present invention.
Figure 2:
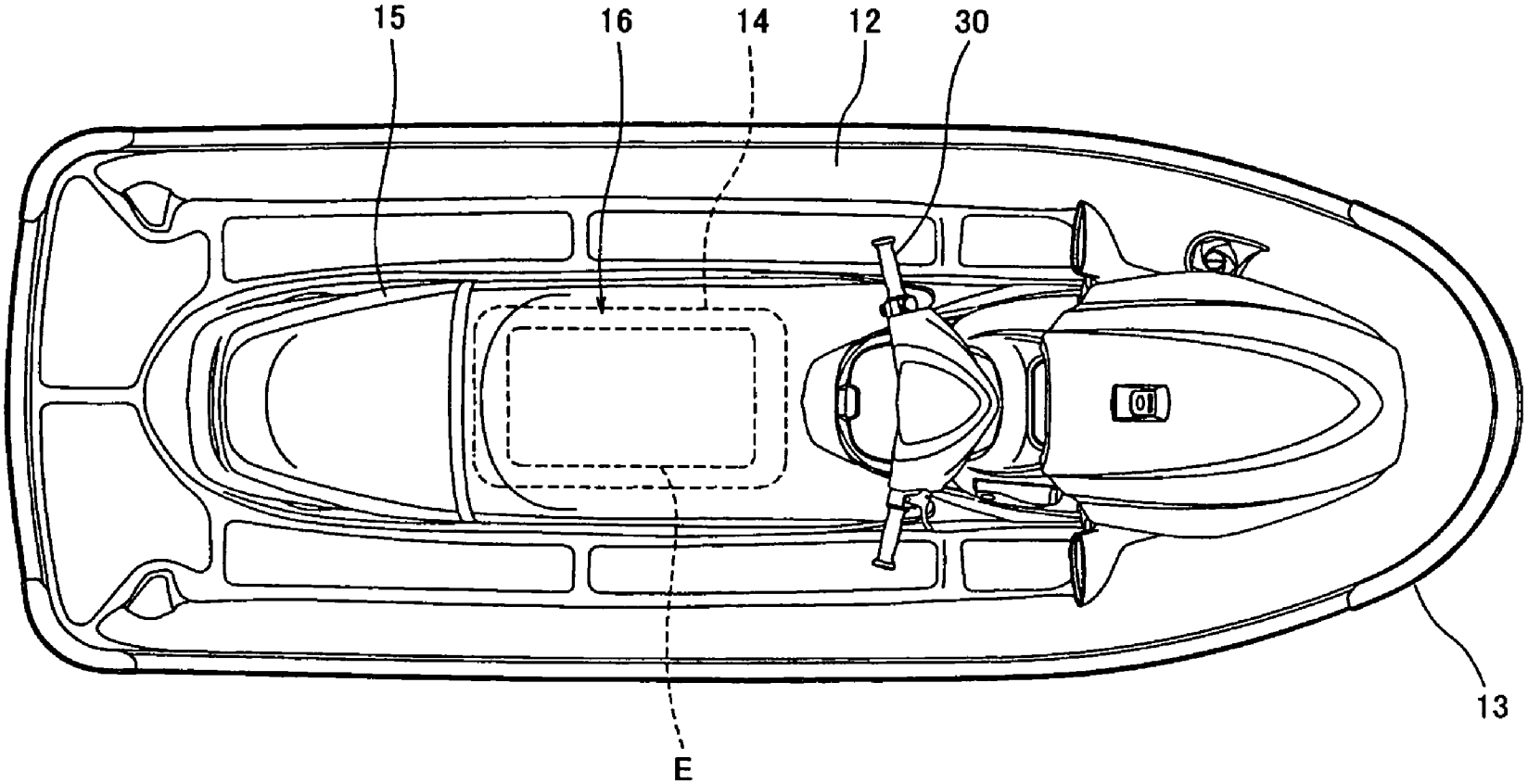
FIG. 2 is a plan view of FIG. 1.
Figure 5:
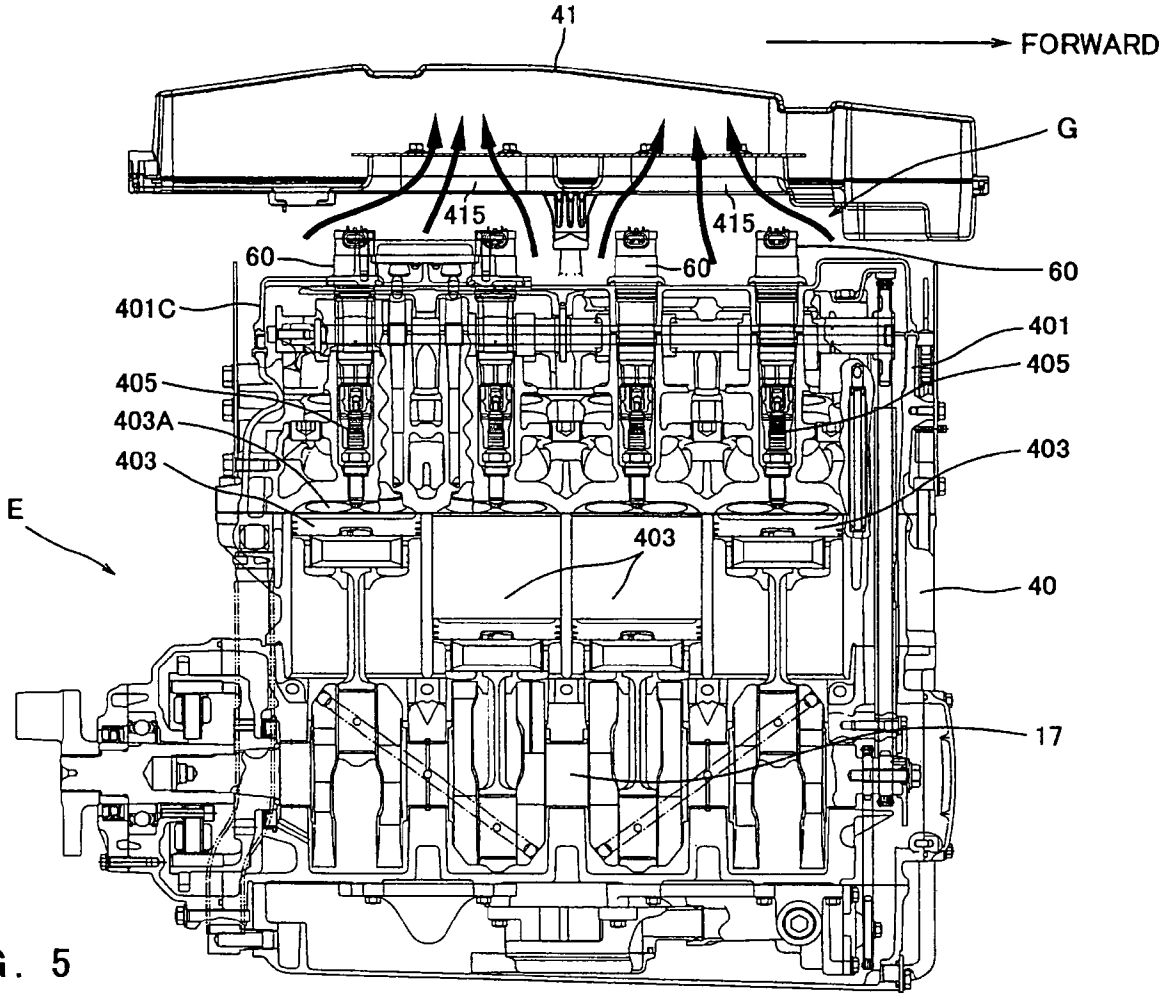
FIG. 5 is a cross-sectional view of the engine equipped with the air-intake device, taken along line V-V of FIG. 3.
Figure 6:
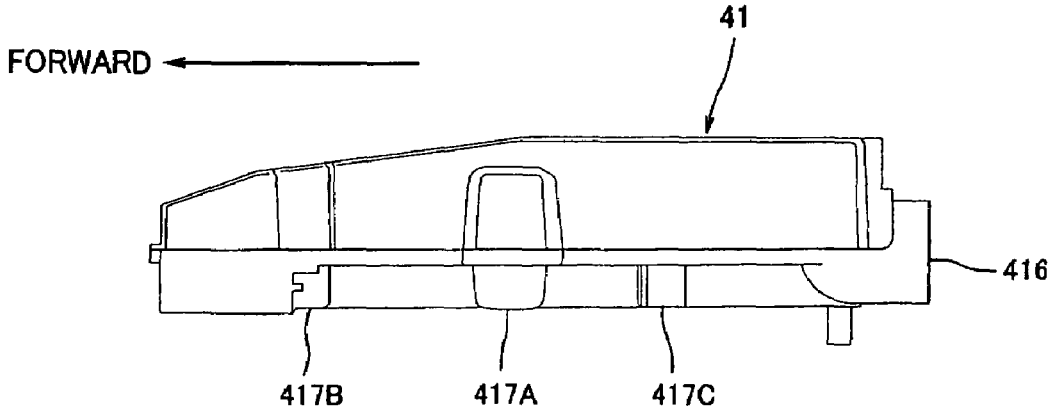
FIG. 6 is a left side view of an air box of FIG. 3.

FIG. 1 is a side view of a personal watercraft equipped with an air-intake device according to an embodiment of the present invention, and FIG. 2 is a plan view thereof. Turning now to FIGS. 1 and 2, a body 10 of the personal watercraft includes a hull 11 and a deck 12 covering the hull 11 from above. The hull 11 and the deck 12 are joined to each other at a gunnel line 13. A substantially rectangular opening 14 is formed on an upper surface of the body 10 at a rear region of a center portion of the deck 12 so as to extend in a longitudinal direction of the body 10. The opening 14 is covered from above with a straddle-type seat 15 extending in the longitudinal direction. An engine E equipped with an air-intake device is mounted in an engine room 16 that is located below the seat 15 and is defined by the hull 11 and the deck 12. In this embodiment, as shown in FIG. 5, the engine E is an in-line four-cylinder four-cycle engine in which cylinders 403 are aligned in a longitudinal direction of a crankshaft 17.

As clearly shown in FIG. 1, the crankshaft 17 of the engine E extends in the longitudinal direction of the body 10 and a rear end portion of the crankshaft 17 is integrally and rotatably coupled to a pump shaft 18 of a water jet pump P through a propeller shaft 19. An impeller 20 is attached on the pump shaft 18 of the water jet pump P. The impeller 20 is covered with a cylindrical pump casing 21 on the outer periphery thereof.

A water intake 22 is provided on a bottom surface of the hull 11. The water is sucked from the water intake 22 and is fed to the water jet pump P through a water passage 23. The water jet pump P pressurizes and accelerates the water by the impeller 20. The water is ejected through a pump nozzle 27 having a cross-sectional area of flow that is gradually reduced rearward, and then from an outlet port 25 provided at a rear end thereof. As the resulting reaction, the watercraft obtains a propulsion force. Fairing vanes 26 serve to guide water flow behind the impeller 20.

As shown in FIGS. 1 and 2, a bar-type steering handle 30 in front of the seat 15 is operative in association with a steering nozzle 28 that is mounted behind the pump nozzle 27 so as to be pivotable rightward or leftward around a pivot shaft (not shown). When the operator rotates the handle 30 clockwise or counterclockwise, the steering nozzle 28 is pivoted to steer the personal watercraft in a desired direction.

As shown in FIG. 1, a bowl-shaped reverse deflector 29 is mounted to an upper region of the steering nozzle 28 so as to be pivotable downward around a pivot shaft 24 horizontally mounted. The deflector 29 is pivoted downward behind the steering nozzle 28 to direct the water ejected rearward from the steering nozzle 28 forward, so that forward movement of the watercraft switches to rearward movement.

Subsequently, with reference to FIGS. 3 to 7, the engine E of this embodiment will be described.

Figure 3:
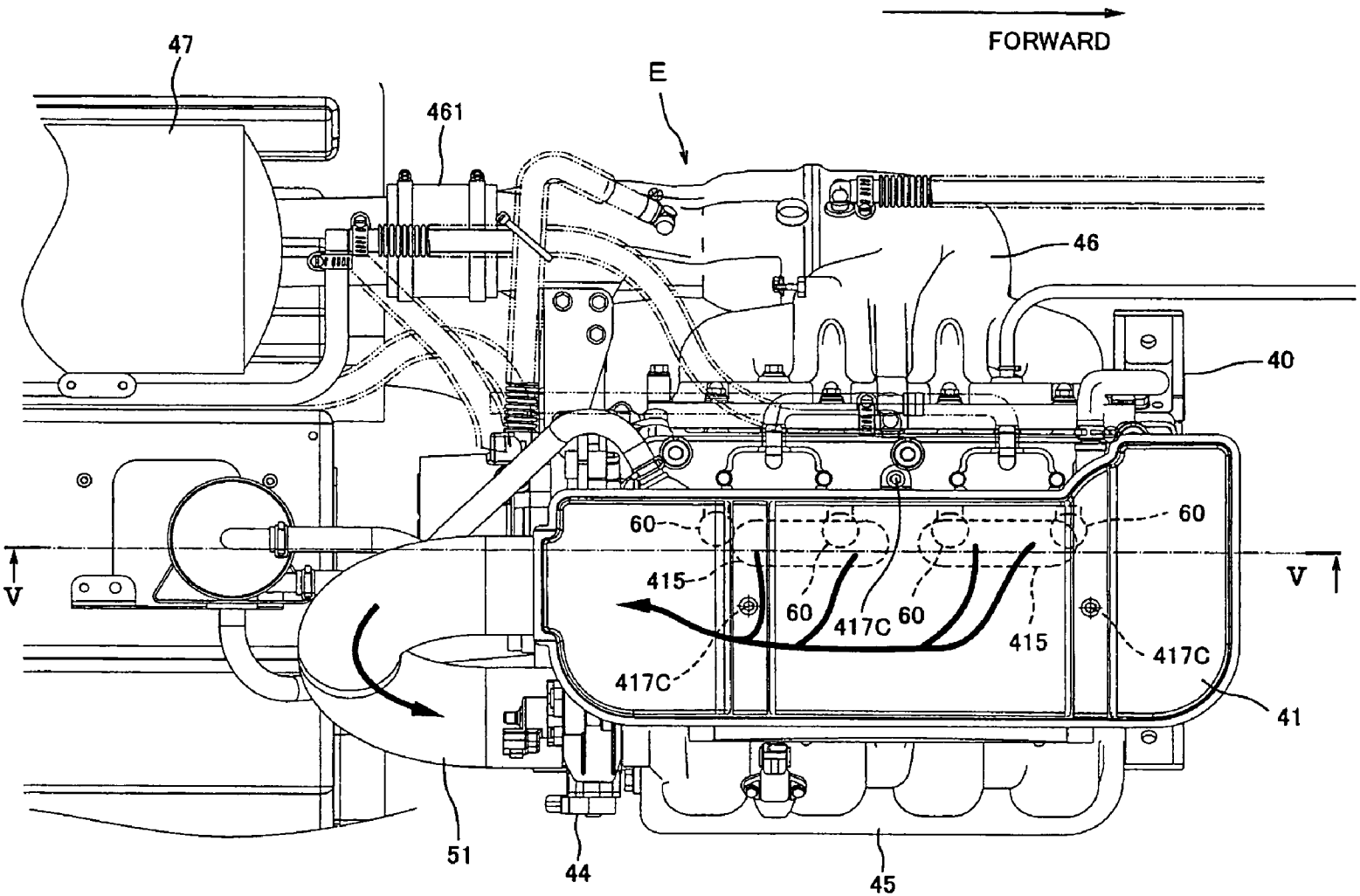
FIG. 3 is a plan view of the engine equipped with the air-intake device of the personal watercraft of FIGS. 1 and 2.
Figure 4:
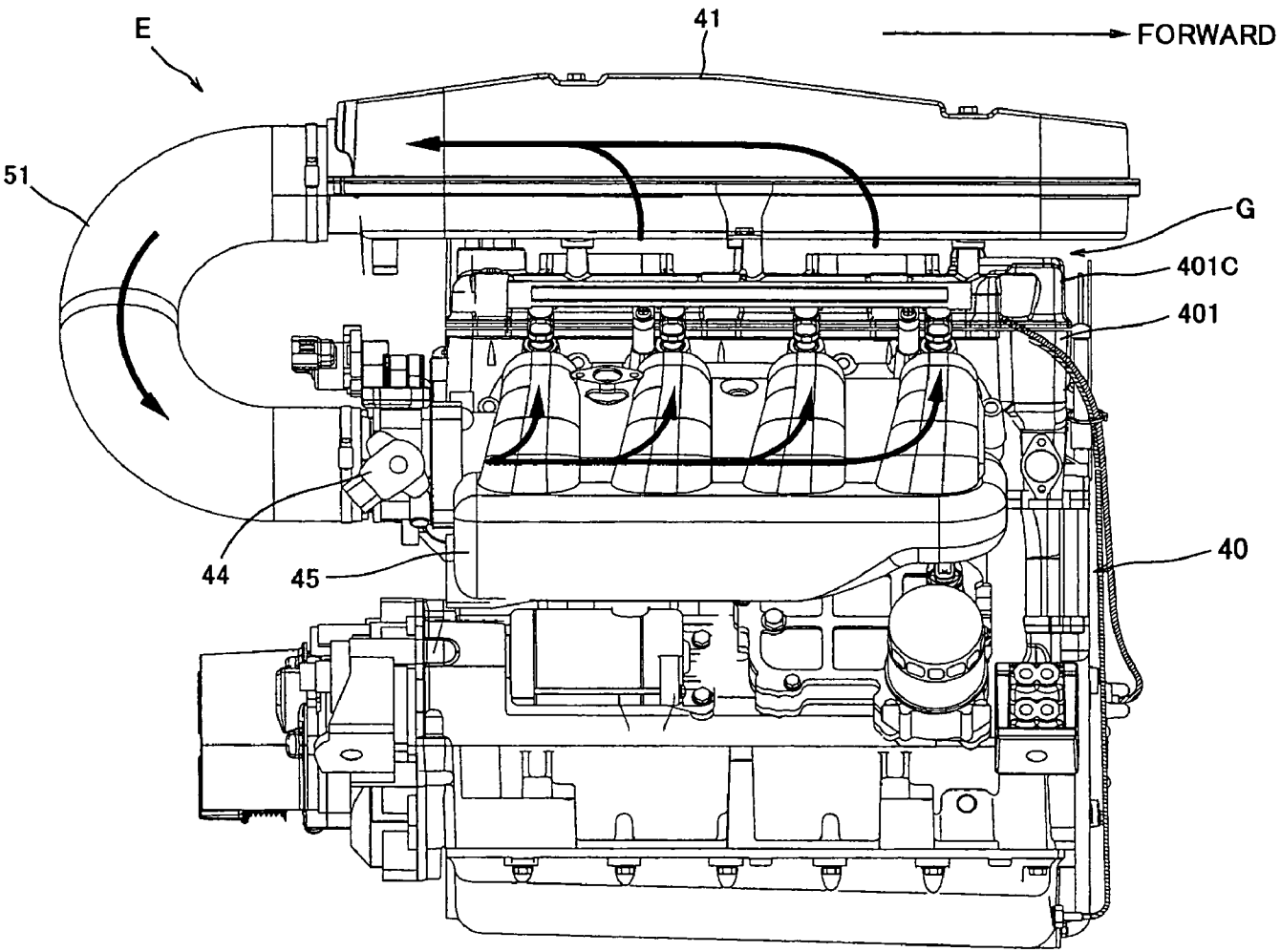
FIG. 4 is a right side view of the engine equipped with the air-intake device of FIG. 3.

As shown in FIGS. 3 and 4, an air box (air-intake box) 41 is mounted to an upper surface of an engine body 40, to be precise, an upper surface of a cylinder head cover 401C attached to an upper surface of a cylinder head 401. As shown in FIGS. 3 and 5, ignition plugs 405 are attached to the cylinder head 401 so as to respectively correspond to four cylinders 403, and plug caps 60 with ignition coils are mounted to upper portions of the ignition plugs 405 to protrude upward from the upper surface of the cylinder head cover 401C. To be more specific, four plug caps 60 with ignition coils protrude from the upper surface of the cylinder head cover 401C and are aligned in the longitudinal direction of the cylinder head cover 401C, i.e., the longitudinal direction of the body 10 of the watercraft. Whereas the four plug caps 60 with ignition coils are provided to respectively correspond to the four cylinders in the engine E of this embodiment, one plug cap 60 with ignition coil may be provided in a single cylinder engine.

The air box 41 has a substantially rectangular hollow box shape and is disposed in such a manner that its longitudinal direction corresponds with the longitudinal direction of the watercraft and the air box 41 covers substantially an entire upper surface of the engine body 40, to be precise, substantially an entire upper surface of the cylinder head cover 401C. The air box 41 is provided with air inlets 415 through which air is introduced into the air box 41. Water and debris are removed from the air through a labyrinth structure (not shown) inside the air box 41. The air box 41 is provided with an air outlet 416 (see FIGS. 6 and 7) formed at a rear end surface to protrude rearward. One end of a flexible air-intake pipe 51 is coupled to the air outlet 416. The air-intake pipe 51 is curved downward so as to form a loop of approximately 180 degrees and is coupled to an air inlet of a throttle device 44.

The throttle device 44 is, for example, a throttle body and includes therein a throttle valve (not shown) whose opening degree is controlled in association with an operation of a throttle lever attached to the steering handle 30 (FIG. 2) so that the amount of clean air fed from the air box 41 and supplied to combustion chambers 403A is suitably controlled. An intake manifold 45 is coupled to an air outlet of the throttle device 44 and the air with a flow rate controlled in the throttle device 44 is fed to the intake manifold 45.

As shown in FIG. 4, the intake manifold 45 extends on a right side surface of an upper region of the engine body 40 over substantially the entire length in the longitudinal direction. The intake manifold 45 is configured to distribute the air with the controlled amount that is fed from the throttle device 44 and to feed the air to the combustion chamber 403A (see FIG. 5) of each cylinder through an intake port (not shown).

After combustion, exhaust gas gathers to an exhaust manifold 46 through an exhaust port (not shown). The exhaust manifold 46 extends on a left side surface of the upper region of the engine body 40 over substantially the entire length in the longitudinal direction. One end of an exhaust pipe 461 (see FIG. 3) is coupled to a rear end portion of the exhaust manifold 46. An opposite end of the exhaust pipe 461 is coupled to a water muffler 47 mounted on a left side behind the engine body 40. In this construction, the exhaust gas gathering to the exhaust manifold 46 is delivered to the water muffler 47 through the exhaust pipe 461 and is finally discharged outside the watercraft.

A structure of the air box 41 equipped in the air-intake device of the engine E according to this embodiment will be described.

Figure 7:
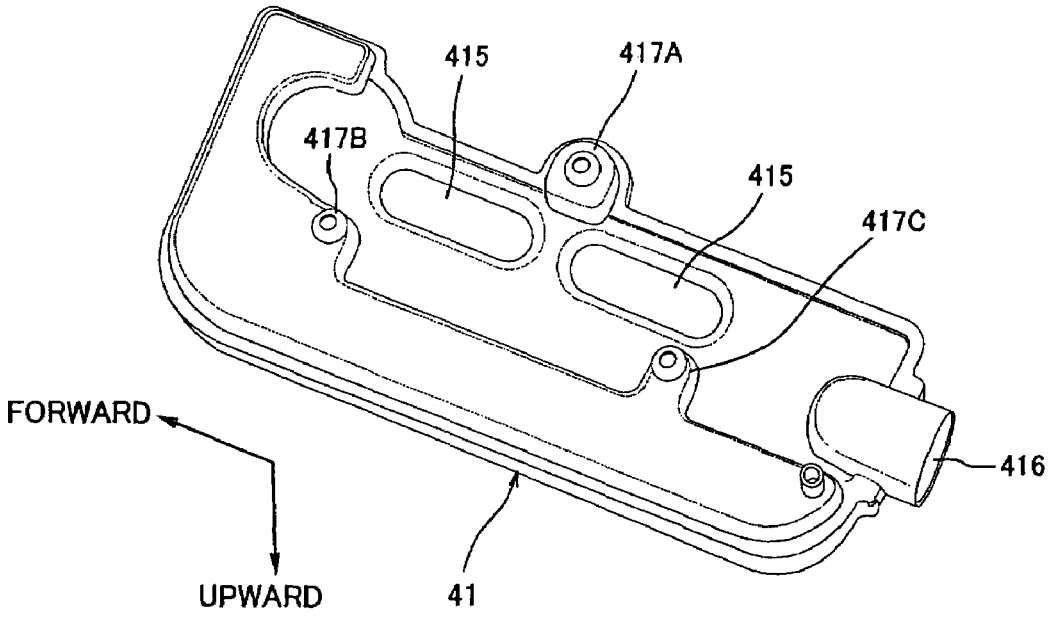
FIG. 7 is a perspective view of the air box as seen from below.

As shown in FIGS. 5 and 7, the air box 41 is provided on a lower surface (bottom surface) thereof with the air inlets 415 and boss portions 417A, 417B, and 417C. The air box 41 is fixedly mounted to the upper surface of the cylinder head cover 401C with a predetermined gap G via the boss portions 417A, 417B, and 417C.

As shown in FIGS. 3 and 5, the air box 41 takes in air around the engine E, i.e., inside the engine room 16 from the air inlets 415 through the gap G. The air inlets 415 are positioned above or in the vicinity of upper ends of the plug caps 60 with ignition coils respectively corresponding to the cylinders that protrude upward from the upper surface of the cylinder head cover 401C located below the air box 41. When the air box 41 takes in the air, an air flow is formed in a region in the vicinity of the upper ends of the plug caps 60 to cool the plug caps 60. This makes it possible to suppress the temperature increase of the plug caps 60. As a matter of course, lower ends of the plug caps 60 are coupled to spark plugs 405.

Since the air inlets 415 open on the lower surface of the air box 41 to be opposite to the upper surface of the cylinder head cover 401C, entry of water splash, debris, and other matter into the air box 41 can be effectively inhibited. In addition, leakage of sound generated by the air-intake inside the air box 41 to the engine room is suppressed with the gap G formed between the upper surface of the cylinder head cover 401C and the lower surface of the air box 41. This makes it possible to effectively reduce the sound generated by the air-intake in contrast to a construction in which air inlets open in an interior of the engine room 16.

As indicated by a broken line of FIG. 3, in this embodiment, two air inlets 415 of an elongate hole shape are arranged along the direction in which the plug caps 60 are aligned, but the number of the air inlets 415 may be changed as desired. If the air inlets 415 are too large in size, then the sound generated by the air-intake undesirably increases or unwanted substances are more likely to enter the air box 41, degrading a function of the air box 41. In addition, since the air is suctioned into the air box 41 through only a part of openings of the air inlets 315 rather than through the entire openings, cooling efficiency of the plug caps 60 is reduced. So, the air inlets 415 are desirably sized to sufficiently cool the plug caps 60 corresponding to the two cylinders. In this embodiment, therefore, two air inlets 415 of the elongate hole shape are provided above the four plug caps 60. Alternatively, air inlets may be provided to respectively correspond to the cylinders. In that case, uneven air flow can be further lessened.

Furthermore, as indicated by the broken line in FIG. 3, to take in the air in the vicinity of the plug caps 60 which move upward due to the temperature increase of the plug caps 60, the air inlets 415 are desirably disposed to include at least a part of regions immediately above the plug caps 60.

In this embodiment, since the engine E is the in-line four-cylinder engine, the air inlets 415 are elongate in shape along the direction in which the cylinders, to be precise, the plug caps 60 are aligned.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An engine equipped with an air-intake device for a personal watercraft, the engine comprising:

a cylinder head cover attached to an upper surface of a cylinder head;

a plug cap with ignition coil configured to protrude upward from an upper surface of the cylinder head cover; and an air box for the air-intake device that is disposed above the cylinder head cover and is provided on a lower surface thereof with an air inlet that opens to be opposite to the upper surface of the cylinder head cover;

wherein the air box is disposed in such a manner that the lower surface of the air box is opposite to the upper surface of the cylinder head cover and a gap is formed between the lower surface of the air box and the upper surface of the cylinder head cover so as to form an air flow in the vicinity of the plug cap with ignition coil that is directed to the air inlet of the air box.

2. The engine equipped with the air-intake device according to claim 1, wherein the plug cap with ignition coil includes a plurality of plug caps with ignition coils;

and wherein the air inlet is provided such that one air inlet corresponds to two plug caps with ignition coils of the plurality of plug caps with ignition coils.

3. The engine equipped with the air-intake device according to claim 1, wherein the air inlet is provided such that one air inlet corresponds to one plug cap with ignition coil.

4. The engine equipped with the air-intake device according to claim 1, wherein the air inlet is disposed to include at least a part of a region immediately above the plug cap with the ignition coil.

5. The engine quipped with the air-intake device according to claim 4, wherein the plug cap with ignition coil includes a plurality of plug caps with ignition coils;

and wherein the air inlet of the air box is formed by a hole elongated along a direction in which the plurality of plug caps with ignition coils are aligned.

6. The engine equipped with the air intake device according to claim 5, wherein the air inlet is provided such that one air inlet corresponds to two plug caps with ignition coils of the plurality of the plug caps with ignition coils.

7. A personal watercraft comprising:

an engine equipped with an air-intake device for a personal watercraft, the engine including:

a cylinder head cover attached to an upper surface of a cylinder head;

a plug cap with ignition coil configured to protrude upward from an upper surface of the cylinder head cover; and an air box for the air-intake device that is disposed above the cylinder head cover and is provided on a lower surface thereof with an air inlet that opens to be opposite to the upper surface of the cylinder head cover;

wherein the air box is disposed in such a manner that the lower surface of the air box is opposite to the upper surface of the cylinder head cover and a gap is formed between the lower surface of the air box and the upper surface of the cylinder head cover so as to form an air flow of air-intake in the vicinity of the plug cap that is directed to the air inlet of the air box.

* * * * *